US005529561A

United States Patent [19]

Wang et al.

[11] Patent Number: 5,529,561

[45] Date of Patent: Jun. 25, 1996

[54] LEG PRESS

[75] Inventors: Leao Wang; Peter Wu, both of Taichung Hsien, Taiwan

[73] Assignee: Greenmaster Industrial Corp., Taichung, Taiwan

[21] Appl. No.: 379,934

[22] Filed: Jan. 27, 1995

[51] Int. Cl.[6] ..... A63B 21/04

[52] U.S. Cl. ..... 482/136; 482/130; 482/123; 482/134; 482/138

[58] Field of Search ..... 482/92, 121, 123, 482/129, 130, 133, 135–139, 142, 145, 146, 147, 907, 908; 601/35

[56] References Cited

U.S. PATENT DOCUMENTS

| | | | |
|---|---|---|---|
| 4,207,879 | 6/1980 | Safadago et al. | 482/142 |
| 4,240,627 | 12/1980 | Brentham | 482/138 |
| 4,349,194 | 9/1982 | Lambert, Jr. et al. | 482/136 |
| 4,478,411 | 10/1984 | Baldwin | 482/136 |
| 5,393,286 | 2/1995 | Cheng | 482/130 |
| 5,409,439 | 4/1995 | Lee | 482/130 |
| 5,435,801 | 7/1995 | Hung | 482/130 |

FOREIGN PATENT DOCUMENTS

| | | | |
|---|---|---|---|
| 3408036 | 9/1985 | Germany | 482/130 |

OTHER PUBLICATIONS

CYBEX Strength Systems, brochure, p. IV–II, Hip Abduction and Hip Adduction machines Mar. 1993.

*Primary Examiner*—Richard J. Apley
*Assistant Examiner*—Victor K. Hwang
*Attorney, Agent, or Firm*—Beveridge, DeGrandi, Weilacher & Young

[57] ABSTRACT

A leg press includes an adjustable foot-rest structure provided near the bottom of a front erect column of a main body for the user to rest his feet thereon as a pivot when doing scissors exercises of the thighs. Two separate cushions are provided on top of two corresponding swing arms. The cushions may synchronously move with the user's thighs to reduce the load of the legs' weight in exercising.

12 Claims, 6 Drawing Sheets

LEG PRESS

BACKGROUND OF THE INVENTION (a) Field of the Invention

The present invention relates generally to an improved leg press, and more particularly to an improved orthopedically engineered leg press which, in addition to being comfortable and safe to use, relieves the tension of the overall leg muscles and reduces the intense leg soreness after exercising.

(b) Description of the Prior Art

A conventional leg press is shown in FIG. 1. It mainly comprises a pair of curved arms 11 connected to a bottom side of a seat 10. A first pair of posts 13 and a second pair of posts 14 are respectively located at the rear and middle sections of a body 12. When a user exercises his leg muscles, resistance elements 15 are fit onto a third post 16 and the second pair of posts 14 at the middle section of the body 12, so that the two curved arms 11 may be moved to the front of the seat 10 while maintaining a suitable distance therebetween. The user may then sit on the seat 10, with the legs placed in the middle of the distance and straddling over two supporting arms 17 which are pushed outward when exercising. Conversely, when training the leg muscles by pushing the supporting arms inward, the resistance elements 15 are inserted onto the third posts 16 and the first posts 13 at the rear section of the body 12. The curved arms 11 may be arranged at both sides of the seat 10, due to the resistance of the resistance elements 15. After the user sits on the seat 10, his/her legs may be extended beyond the supporting arm 17 and straddle thereon, and the supporting arms 17 are pushed inwardly for exercising purposes.

Although the structure of this prior art is simple and easy to use, when the user trains his leg muscles by such scissors exercises in which the supporting arms 17 are pushed outwardly or inwardly, the legs must be straight and parallel to the ground, because the distance between the height of the seat 10 and the ground is small. FIG. 2 shows the sitting posture and position of the legs. If the user wishes to have his/her feet on the ground when doing exercise, his/her legs possibly may not rest against the supporting arms 17 when proceeding with the desired exercises. However, as is well known, when the user is in such a posture, his/her hip muscles, thigh muscles and shin muscles must be in a tense state for a long time so that the sitting posture may be maintained. Although supporting arms 17 are provided for helping to support the thighs, he/she still has to try to support the weight of the shins. The above-mentioned posture in exercising results in extremely unnatural movements of the shins, so that the user feels very exhausted within a very short time. In particular, the lower part of the body and the waist suffers intense soreness. In other words, it is not easy to keep the legs horizontal to the ground in exercising, especially when the user has to further push the supporting arms 17 inwardly or outwardly.

Furthermore, a T-shaped bar 18 is pivotally connected to the front section of the body 12. The T-shaped bar 18 is further connected to a horizontal post 19 extending from one side of the T-shaped bar 18, for matching a corresponding horizontal post 21 provided on an oblique block 20 at the front section of the body 12 for insertion of a resistance element 15. By means of the above, the user may sit on the seat 10 with his/her feet placed upon the top sides of the T-shaped bar 18 to do kicks. A most important drawback of the prior art resides in the direction of exercising. In brief, because the prior leg press mainly permits forward kicking exercising, if the user inadvertently slips his/her feet off the T-shaped bar 18 which is bent by force exerted thereon, the T-shaped bar 18 may quickly reset to its original position due to the strong resilient action of the resistance elements 15. Then the T-shaped bar 18 may hit the user's legs and cause serious injuries thereto.

SUMMARY OF THE INVENTION

The primary object of the present invention is to provide an improved orthopedically engineered leg press which is simple and comfortable to use, whereby possible intense muscle soreness may be reduced, and is suitable for use by people of various ages.

Another object of the present invention is to provide an improved leg press wherein free kicking exercises are replaced by lifting of the shins to prevent possible slipping of the legs, so as to increase the safety of using the leg press.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
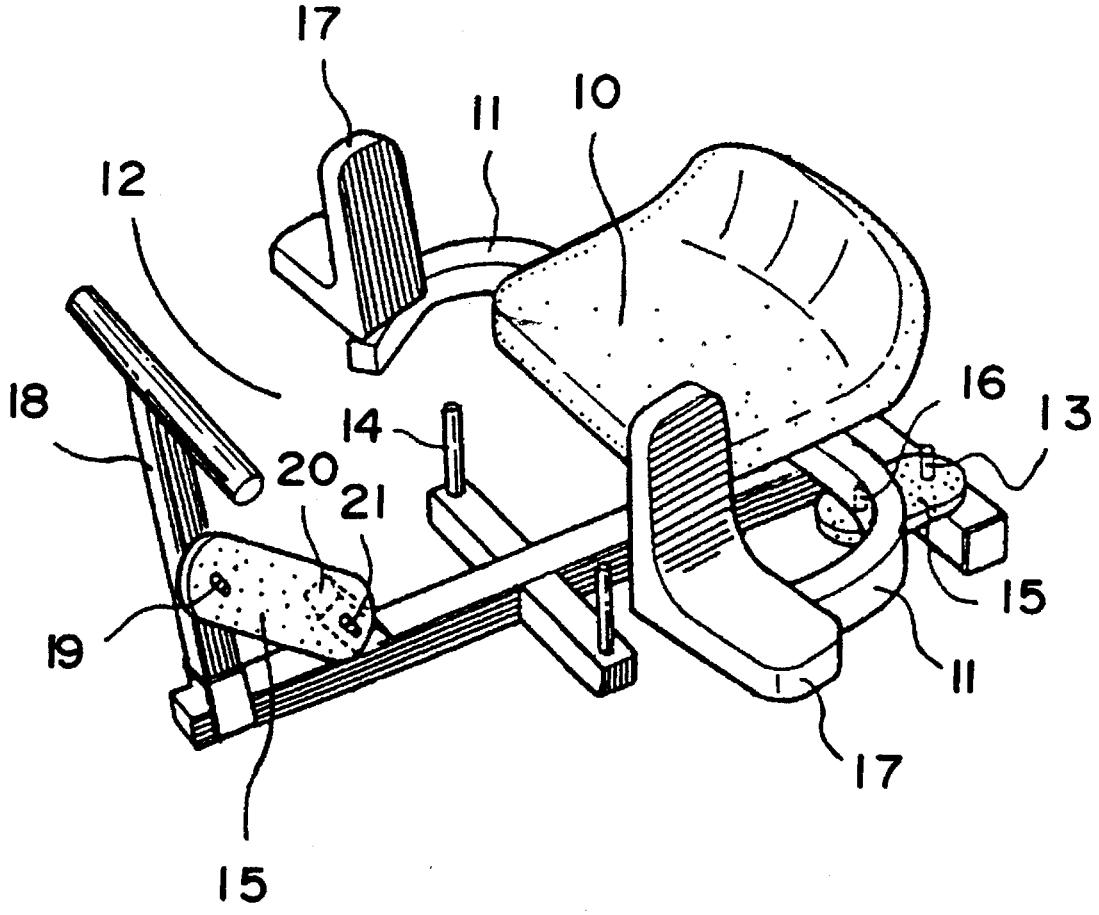
FIG. 1 PRIOR ART
FIG. 1 is a perspective view of the conventional leg press in an assembled state.
Figure 2:
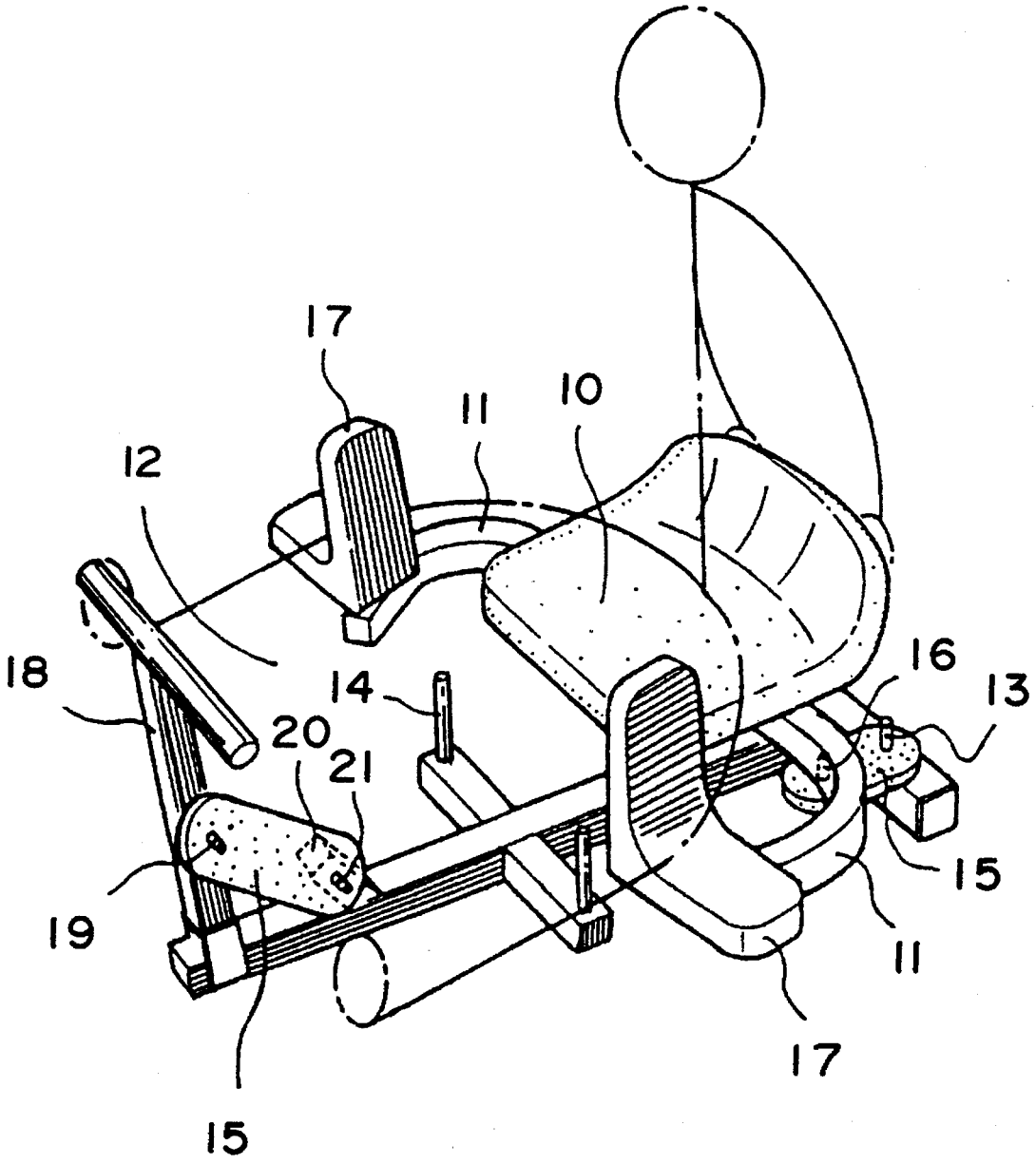
FIG. 2 PRIOR ART
FIG. 2 is perspective view of the conventional leg press, indicating the posture of the user in exercise.
Figure 3:
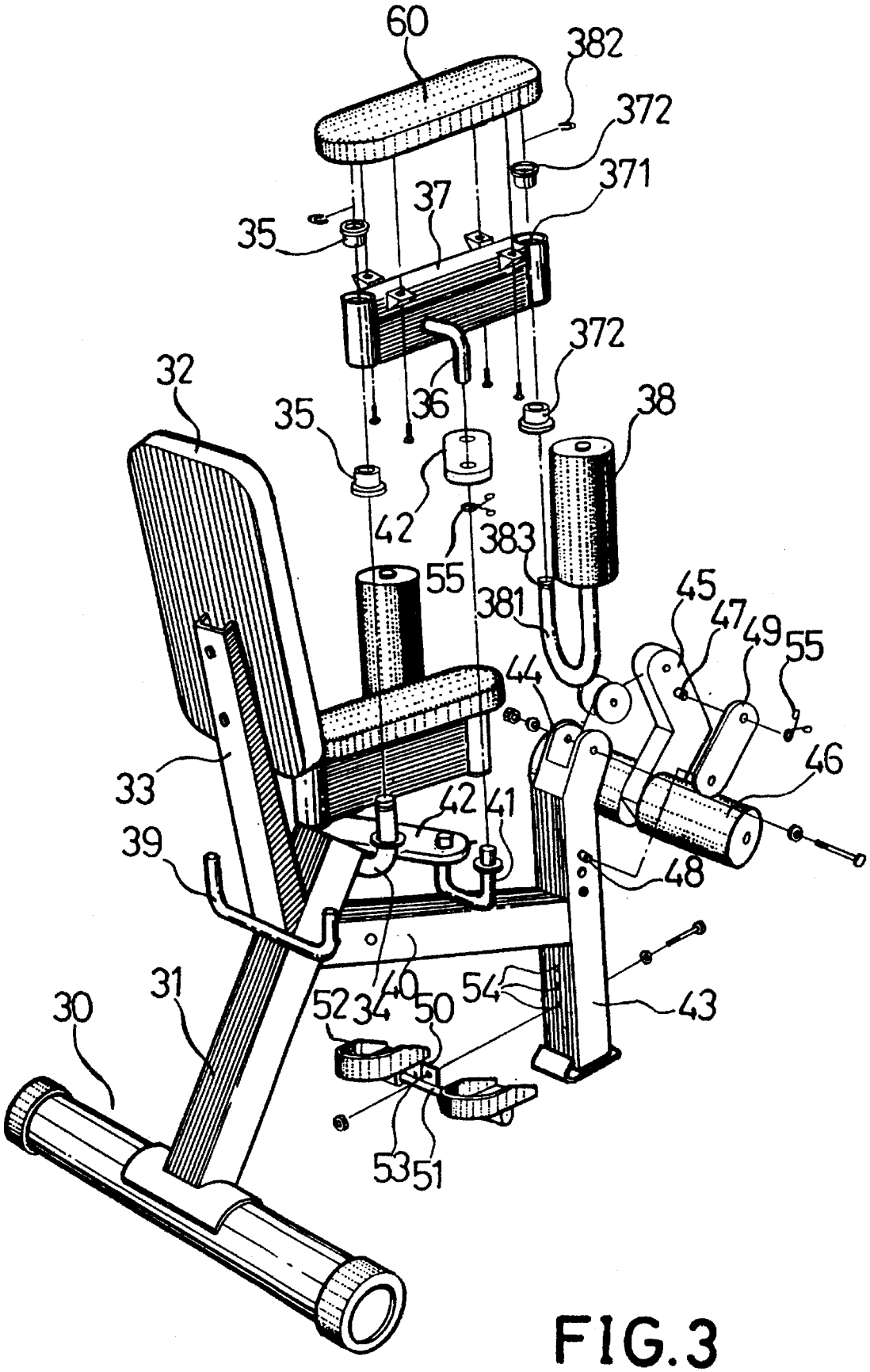
FIG. 3 is partial exploded perspective view of the present invention.
Figure 4:
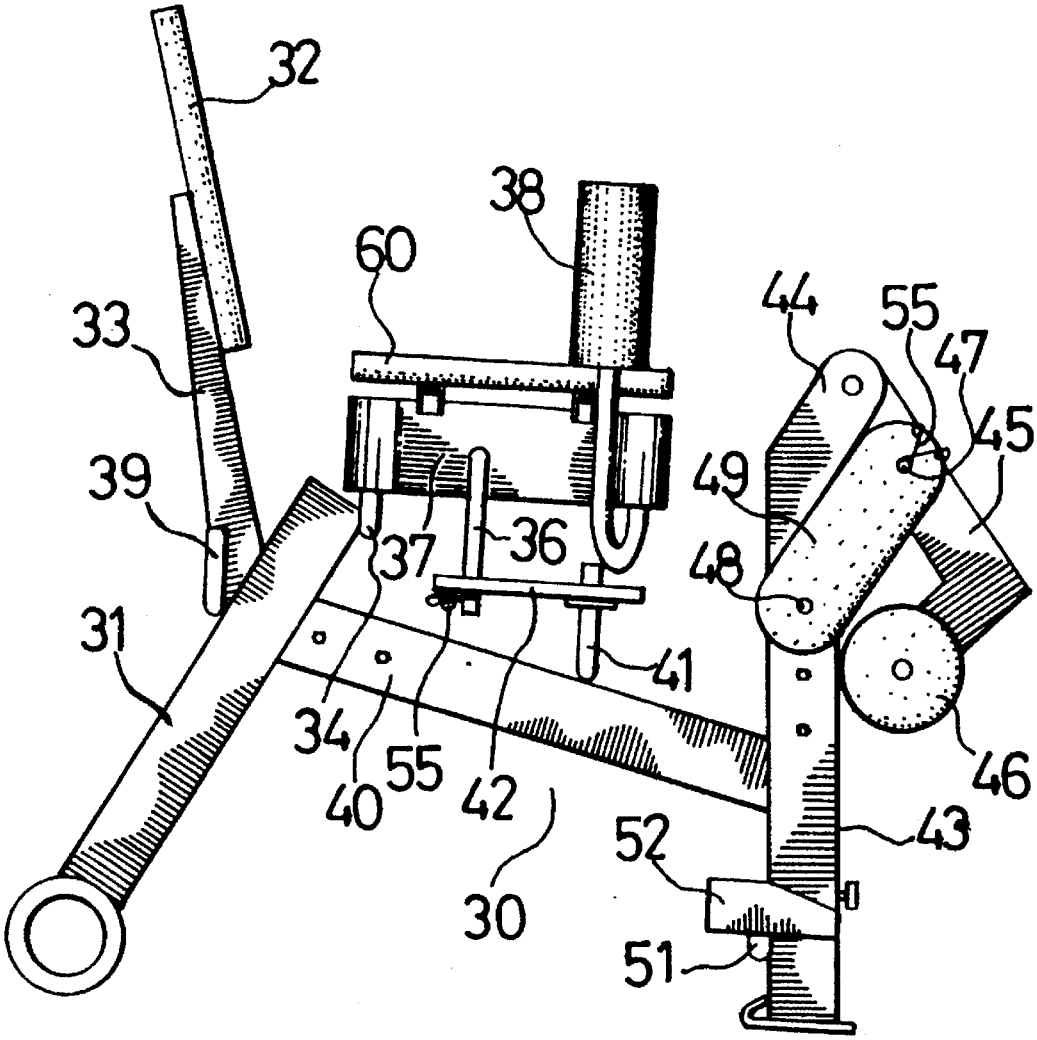
FIG. 4 is a side view of the present invention.
Figure 5:
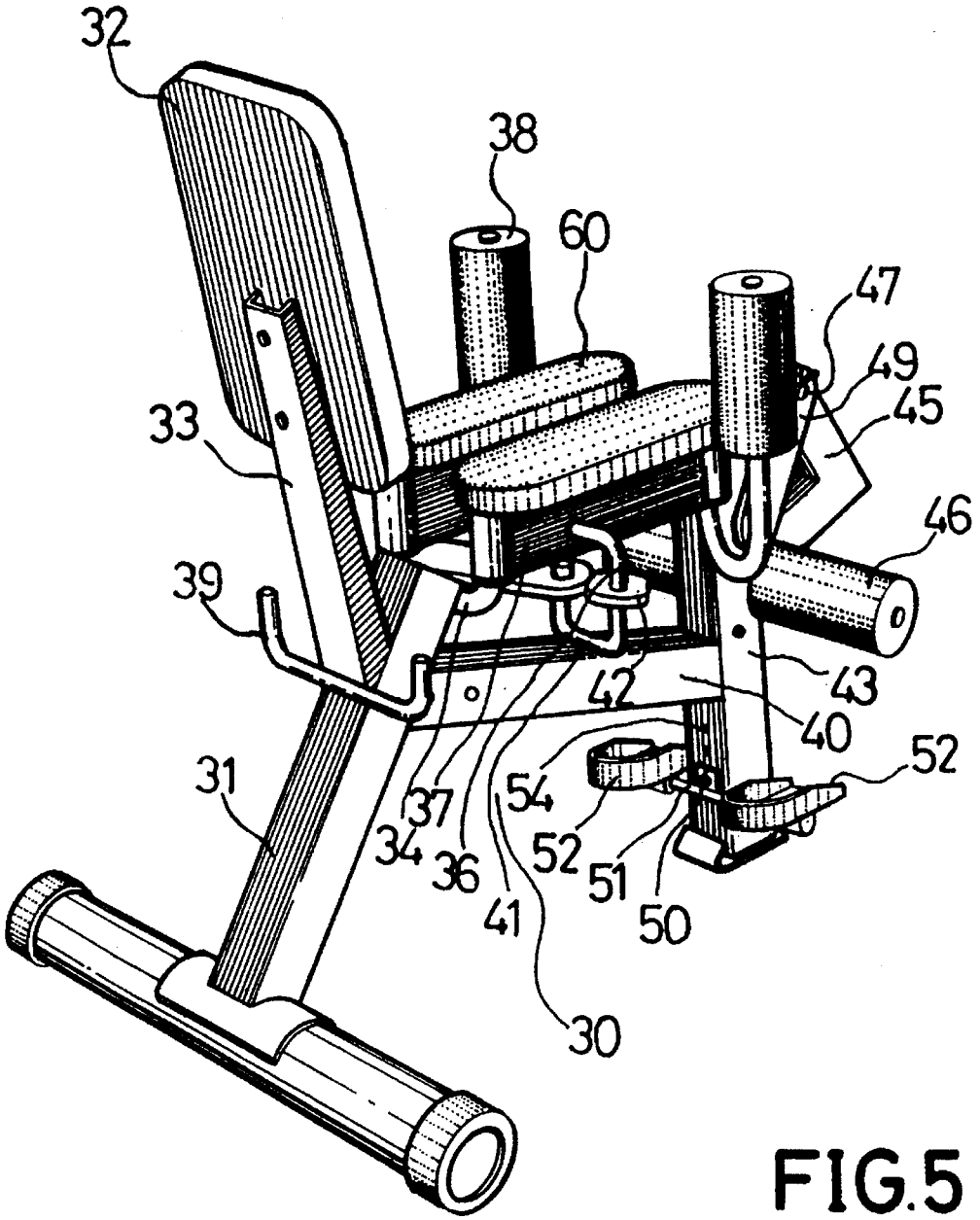
FIG. 5 is a perspective view of the thigh developing mechanism of the present invention in a condition for scissors exercises of the legs wherein the resistance elements are pushed outwardly.
Figure 6:
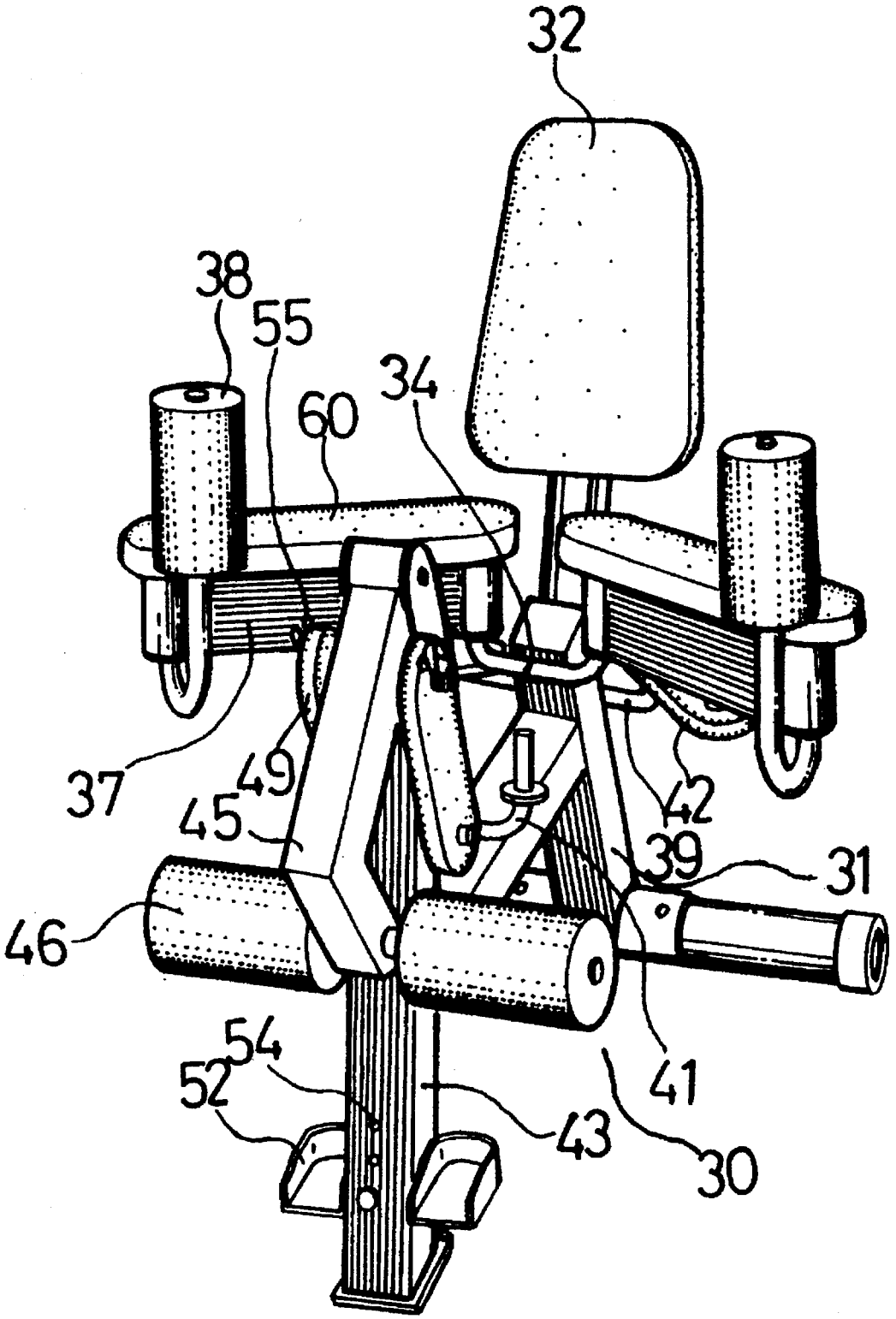
FIG. 6 is another perspective view of the thigh developing mechanism of the present invention in a condition for scissors exercises of the legs wherein the resistance elements are pushed inwardly.

With reference to FIGS. 3 and 4, the present invention comprises a body 30 and an erect column 33 having a back 32 extended from a slanting bar 31 at a rear section thereof, and a U-shaped bar 34 securely fixed at the top side of the slanting bar 31. The main design of the present invention includes a thigh developing mechanism for use in scissors exercises, a leg lifting mechanism and a foot-rest mechanism. The thigh developing mechanism consists of a pair of swing arms 37, each of which is pivotally connected to the U-shaped bar 34 at a relative outer side thereof by means of a sleeve 35. Pivotally provided at an end of the swing arm 37 and opposite to the U-shaped bar 34 is an application arm 38 wrapped with foam rubber and which extends vertically to the swing arm 37. Therefore, by using the above structure in conjunction with a first U-shaped rod 39 at an outer end of the slanting rod 31 at the rear section of the body 30 and a second U-shaped rod 41 provided on a slanting bar 40 at a middle section of the body 30, the user may fit rubber resistance elements 42 onto angular rods 36 provided on the respective swing arms 37 and onto the second U-shaped rod 41 (as shown in FIG. 5) when exercising the legs by pushing the resistance elements outwardly. On the contrary, the resistance elements 42 are fitted onto the angular rods 36 on the respective swing arms 37 and onto the first U-shaped rod 39 (as shown in FIG. 6) for the user to push the resistance elements inwardly.

Two independent cushions 60 are respectively provided on an upper surface of the respective swing arms 37. The cushions 60 may serve as seat cushions in addition to being synchronously displaced with the respective swing arms 37 with the movement of the user's legs for supporting the weight of the user's legs to facilitate leg exercises.

The leg lifting mechanism consists of a U-shaped positioning element 44, wherein a link 45 that is slightly bent is pivotally connected to the positioning element 44 with a washer disposed therebetween. Additionally, two application arms 46 wrapped with foam rubber are securely fixed on both sides of the link 45 at an end thereof. A resistance element 49 may be attached between a horizontally extending rod 47 at a middle section of the link 45 and a rod 48 near a top end of an erect column 43 at a front section of the body 30. A clip element 55 may be used to secure the resistance element 49 on the rod 47, as shown in FIGS. 3, 4 and 6.

As for the manner of pivotally connecting the application arms 38 and the respective swing arms 37, after sleeves 372 are provided on holes 371 in each swing arm 37, and a bent section 381 of the application arm 38 is made to insert into the corresponding sleeve 372 upwardly. A retainer 382 is inserted into a groove 383 for positioning purposes. Therefore, when extending the thighs, the two application arms 38 are turned to the relative outer sides of the swing arms 37 and, when the resistance elements are to be pushed inwardly, the two application arms 38 are turned back to the relative inner side of the two swing arms 37.

The foot-rest mechanism consists of a sheet-like locking element 50 connected to a connecting rod 51 and two foot-pads 52. The foot-pads 52 are respectively pivotally connected to an end of the connecting rod 51. A through hole 53 is provided in the center of the locking element 50. As for the manner of assembly, the locking element 50 is directly disposed near a bottom end of the inner side of the erect column 43 at the front section of the body 30. A multiplicity of through holes 54 are provided at suitable positions in the erect column 43, and the through holes 54 correspond to the through hole 53 of the locking element 50. Therefore, by means of a screw passing through the respective through holes 53 and 54, the foot-rest mechanism may be fastened to the erect column 43 at a suitable position to match the user's legs. When the user wishes to perform thigh developing exercises, he/she may place his/her feet on the foot-pads 52 which serve as the rotation pivot. This arrangement helps to relieve muscle soreness due to tension to enhance comfort in exercising.

To prevent the resistance elements 42, 49 from accidentally slipping out when being pulled or reset, an annular groove is respectively provided at a suitable position at an outer end of the rods 36, 39, 47 and 48 for receiving a positioning clip element 55, which is a known element and will not be described in detail herein.

Although the present invention has been illustrated and described with reference to the preferred embodiment thereof, it should be understood that it is in no way limited to the details of such embodiment, but is capable of numerous modifications within the scope of the appended claims.

What is claimed is:

1. A leg press, comprising:

a body including:

a slanting bar provided at a rear section of the body, a rear erect column extending from the slanting bar, a back attached to the rear erect column, a U-shaped bar provided at a top of the slanting bar, and a front erect column provided at a front section of the body;

a thigh developing mechanism connected to the body, wherein the thigh developing mechanism includes:

a first swing arm pivotally connected to the U-shaped bar of the body, a second swing arm pivotally connected to the U-shaped bar of the body, a first application arm provided at a first end the first swing arm, and a second application arm provided at a first end of the second swing arm; and a foot-rest mechanism connected to the body, wherein the foot-rest mechanism includes:

a connecting rod, a first foot-pad connected to a first end of the connecting rod, a second foot-pad connected to a second end of the connecting rod, and a locking element connected to the connecting rod, wherein the locking element is adjustably mounted to a bottom end of the front erect column of the body.

2. A leg press as claimed in claim 1, further including:

a first cushion provided on a top surface of the first swing arm, wherein the first cushion moves synchronously with the first swing arm, and a second cushion provided on a top surface of the second swing arm, wherein the second cushion moves synchronously with the second swing arm.

3. A leg press as claimed in claim 1, wherein:

the first application arm includes a bent section which is inserted into a hole defined in the first end of the first swing arm to connect the first application arm to the first swing arm, and the second application arm includes a bent section which is inserted into a hole defined in the first end of the second swing arm to connect the second application arm to the second swing arm.

4. A leg press as claimed in claim 3, wherein:

a top portion of the bent section of the first application arm has a first groove defined therein, and a first retainer provided in the first groove for positioning the first application arm with respect to the first swing arm, and a top portion of the bent section of the second application arm has a second groove defined therein, and a second retainer provided in the second groove for positioning the second application arm with respect to the second swing arm.

5. A leg press, comprising:

a body including:

a slanting bar provided at a rear section of the body, a rear erect column extending from the slanting bar, a back attached to the rear erect column, a U-shaped bar provided at a top of the slanting bar, and a front erect column provided at a front section of the body, wherein a bottom end of the front erect column includes a plurality of holes;

a thigh developing mechanism connected to the body, wherein the thigh developing mechanism includes:

a first swing arm pivotally connected to the U-shaped bar of the body, a second swing arm pivotally connected to the U-shaped bar of the body, a first application arm provided at a first end the first swing arm, and a second application arm provided at a first end of the second swing arm; and a foot-rest mechanism connected to the body, wherein the foot-rest mechanism includes:

a connecting rod, a first foot-pad connected to a first end of the connecting rod, a second foot-pad connected to a second end of the connecting rod, and a locking element connected to the connecting rod, wherein a through hole is defined in the locking element, wherein the locking element is adjustably mounted to the bottom end of the front erect column of the body via the through hole defined in the locking element and one of the plurality of holes of the front erect column.

6. A leg press as claimed in claim 5, further including:

a first cushion provided on a top surface of the first swing arm, wherein the first cushion moves synchronously with the first swing arm, and a second cushion provided on a top surface of the second swing arm, wherein the second cushion moves synchronously with the second swing arm.

7. A leg press as claimed in claim 5, wherein:

the first application arm includes a bent section which is inserted into a hole defined in the first end of the first swing arm to connect the first application arm to the first swing arm, and the second application arm includes a bent section which is inserted into a hole defined in the first end of the second swing arm to connect the second application arm to the second swing arm.

8. A leg press as claimed in claim 7, wherein:

a top portion of the bent section of the first application arm has a first groove defined therein, and a first retainer provided in the first groove for positioning the first application arm with respect to the first swing arm, and a top portion of the bent section of the second application arm has a second groove defined therein, and a second retainer provided in the second groove for positioning the second application arm with respect to the second swing arm.

9. A leg press, comprising:

a body including:

a slanting bar provided at a rear section of the body, a rear erect column extending from the slanting bar, a back attached to the rear erect column, a U-shaped bar securely fixed on a top surface of the slanting bar, and a front erect column provided at a front section of the body, wherein the front erect column includes a plurality of holes defined at a bottom end of the front erect column;

a thigh developing mechanism connected to the body, wherein the thigh developing mechanism includes:

a first swing arm pivotally connected to the U-shaped bar of the body through a first sleeve, a second swing arm pivotally connected to the U-shaped bar of the body through a second sleeve, a first application arm pivotally provided at a first end of the first swing arm, wherein the first application arm extends vertically, a second application arm pivotally provided at a first end of the second swing arm, wherein the second application arm extends vertically, a first foam rubber cover provided around the first application arm, and a second foam rubber cover provided around the second application arm; and a foot-rest mechanism connected to the body, wherein the foot-rest mechanism includes:

a connecting rod, a first foot-pad pivotally connected to a first end of the connecting rod, a second foot-pad pivotally connected to a second end of the connecting rod, and a locking element connected to the connecting rod, wherein a through hole is defined in the locking element, wherein the locking element of the foot-rest mechanism is connected to the front erect column of the body by connecting the through hole defined in the locking element to one of the plurality of holes defined in the front erect column by a screw.

10. A leg press as claimed in claim 9, further including:

a first cushion provided on a top surface of the first swing arm, wherein the first cushion moves synchronously with the first swing arm in conjunction with movement of a first leg of a user, and a second cushion provided on a top surface of the second swing arm, wherein the second cushion moves synchronously with the second swing arm in conjunction with movement of a second leg of a user.

11. A leg press as claimed in claim 9, wherein:

the first application arm includes a bent section which is inserted into a hole defined in the first end of the first swing arm to connect the first application arm to the first swing arm, and the second application arm includes a bent section which is inserted into a hole defined in the first end of the second swing arm to connect the second application arm to the second swing arm.

12. A leg press as claimed in claim 11, wherein:

a top portion of the bent section of the first application arm has a first groove defined therein, and a first retainer provided in the first groove for positioning the first application arm with respect to the first swing arm, and a top portion of the bent section of the second application arm has a second groove defined therein, and a second retainer provided in the second groove for positioning the second application arm with respect to the second swing arm.

* * * * *